US005363683A

United States Patent [19]

Thudium et al.

[11] Patent Number: 5,363,683

[45] Date of Patent: Nov. 15, 1994

[54] FORMING MACHINE

[75] Inventors: Karl Thudium, Wäschenbeuren; Walter Rieger, Göppingen, both of Germany

[73] Assignee: L. Schuler GmbH, Germany

[21] Appl. No.: 147,536

[22] Filed: Nov. 5, 1993

[30] Foreign Application Priority Data

Nov. 5, 1992 [DE] Germany ..... 4237312

[51] Int. Cl.[5] ..... B21D 43/05

[52] U.S. Cl. ..... 72/405

[58] Field of Search ..... 72/405, 422; 198/621

[56] References Cited

U.S. PATENT DOCUMENTS

| | | | |
|---|---|---|---|
| 3,342,125 | 9/1967 | Curran | 72/405 |
| 3,948,162 | 4/1976 | Numba | 72/405 |
| 4,378,592 | 3/1983 | Heiberger | 72/405 |
| 4,641,515 | 2/1987 | Braun | 72/405 |
| 5,048,318 | 9/1991 | Thudium | 72/405 |

FOREIGN PATENT DOCUMENTS

| | | | |
|---|---|---|---|
| 2411447 | 9/1975 | Germany | 72/405 |
| 2713706 | 10/1977 | Germany | 72/405 |
| 1604291 | 12/1981 | Germany | 72/405 |
| 3905068 | 8/1990 | Germany . | |
| 3931081 | 3/1991 | Germany . | |
| 1249394 | 10/1971 | United Kingdom | 72/405 |

*Primary Examiner*—Daniel C. Crane

*Attorney, Agent, or Firm*—Evenson, McKeown, Edwards & Lenahan

[57] ABSTRACT

A transfer press or similar forming machine is provided with a transfer device having holding devices for the gripping and transport of sheet metal parts. During the transfer movement of the sheet metal parts from one machining stage to the next, the sheet metal parts are deposited intermediately on an intermediate depositing device. The intermediate depositing device takes over a partial path of the transfer so that the movement of the holding devices is less than half the distance between the machining stages.

1 Claim, 3 Drawing Sheets

1
2
3
4
5
6
7
7¹
7²
9
9¹
10
11
11¹
12
12¹
13
14
15
16
17
18
18¹

FORMING MACHINE

BACKGROUND AND SUMMARY OF THE INVENTION

The present invention relates to a transfer press, motor vehicle body press, press line or similar forming machine or facility comprising a transfer device with holding devices, which are moved by the press drive, for the gripping and transport of sheet metal parts through the forming machine, comprising at least one intermediate depositing device between two machining stations which has templates for the supporting of the sheet metal parts which can be moved by means of adjusting devices and movement deflecting devices in their height, their oblique position and horizontally with respect to the sheet metal part to be deposited and gripped by the holding devices.

Forming machines include multiple die presses, vehicle body presses, press lines, multistage presses, transfer presses on which sheet metal parts, also those of large dimensions, are formed, for example, into vehicle body parts. Because of the size of the sheet metal parts to be formed, the distance of the machining stages from one another and therefore the transport path is large.

In U.S. Pat. No. 5,001,291, a transfer device in a forming machine is described which has an intermediate depositing device provided behind each machining stage. In this case, the transfer movement of the sheet metal parts from a machining stage into an intermediate depositing device and out of this intermediate depositing device into the machining stage that follows takes place by means of suction bars which are mounted on travelling carriages guided in running rails.

In U.S. Pat. No. 5,048,318, an intermediate depositing device is described on which sheet metal parts are intermediately deposited. For this purpose, this intermediate depositing device has templates which can be adjusted with respect to their height and in their oblique position and in other movements. One of these movements is a correcting movement for the compensation of errors after the swivelling of the metal sheet. For this purpose, the mounting plate which carries the mounting of the intermediate depositing device is disposed horizontally in the direction of the transfer movement in rails and can be displaced by way of an adjusting device, a motor and a spindle.

An object of the present invention is to provide a forming machine in which a portion of the path of the transfer device is carried out by the intermediate depositing device in order to increase the number of strokes of the forming machine or facility and in order to enlarge the sheet metal parts to be transported. The transfer movement of the transfer device will intentionally be dimensioned to be shorter so that the intermediate depositing device will take over a portion of the whole transfer path.

This and other objects are achieved by the present invention which provides a forming machine comprising at least two machining stages, a transfer device with holding devices that are moved by a press drive for the gripping and transport of sheet metal parts through the forming machine, and at least one intermediate depositing device movably mounted along a transfer direction on horizontally extending rails between the two machining stations. The intermediate depositing device has at least one template for supporting the sheet metal parts. An adjusting device is coupled to the intermediate depositing device and adjusts the intermediate depositing device in height, oblique position and horizontally with respect to the sheet metal part to be deposited and gripped by the holding devices. The transfer movement of the holding devices is less than half the distance between two successive machining stages such that a partial path between the machining stages is not bridged by the transfer device, and the adjusting device has a range of action such than the intermediate depositing device is moved over the partial path.

In addition to an improved utilization of the forming machine, another advantage of the invention is the more favorable design of the transfer device while the possibilities of the depositing device are used without the requirement of having to design the intermediate depositing device in a more expensive or more complicated manner. In this case, the present invention moves away from the conventional idea that the transfer devices must cause the whole movement of the sheet metal parts.

Other objects, advantages and novel features of the present invention will become apparent from the following detailed description of the invention when considered in conjunction with the accompanying drawings.

DETAILED DESCRIPTION OF THE DRAWINGS

Figures 1, 2, 3:
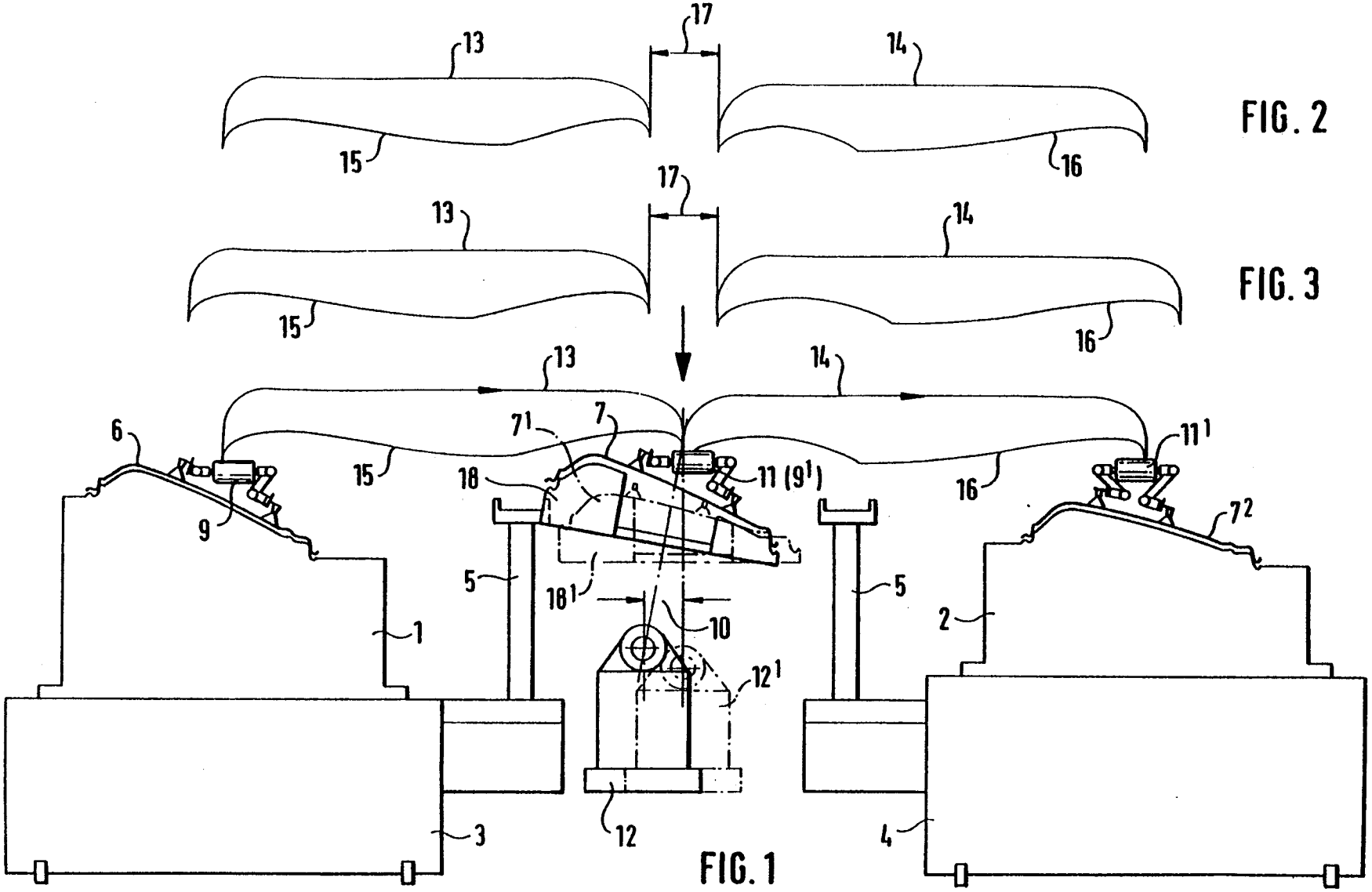
FIG. 1 is a representation of a diagram of the transfer movements generated by the drive of the forming machine of the prior art.
FIGS. 2 and 3 are representations of diagrams of the transfer movement of the present invention.

With reference to FIG. 1, tools, of which the tool bottom parts 1 and 2 are indicated, are inserted in a forming machine via sliding tables 3 and 4 which can be moved into and out of the forming machine. In the center between the machining stages characterized by the tool bottom parts 1 and 2, an intermediate depositing device 12 is indicated which, in a manner described with respect to U.S. Pat. No. 5,048,318 (herein incorporated by reference) for compensating the error during the rotation of the templates 18, can be transferred into position $\mathbf{18}^1$ with the supported sheet metal part 7, $\mathbf{7}^1$ in position $\mathbf{12}^1$.

A sheet metal part 6 rests on the tool bottom part 1 which, by means of the drive and the suction bar 9 known from U.S. Pat. No. 5,001,291, can be transferred in the transfer movement 13 and can be deposited on the intermediate depositing device 12 in position 12 shown in solid lines. At the same time, the sheet metal part $\mathbf{7}^1$, which is rotated into position $\mathbf{18}^1$ (shown in interrupted lines) on the templates 18. By the moving of the intermediate depositing device into position $\mathbf{12}^1$, the sheet metal part $\mathbf{7}^1$ is newly aligned with the tool bottom part 2, and is moved by means of suction bar 11 to rest on the tool bottom part 2.

As indicated in FIGS. 1, 2, 3, the transfer movement 13 and 14 of the suction bars 9, 11 may take place in the same movement; the return movement 15 and 16, caused by the driven may take place with a moving delay in the area of the supports 5 on the sliding tables 3, 4 during the downward movement of the slide. While FIG. 1 is based on a transfer movement for the sheet metal parts 6, 7 which, as a whole, is carried out by the suction bars 9, 11, FIGS. 2 and 3 illustrate by means of diagrams the sequences of the transfer movement and the return movement of the present invention which omit a portion 17 of the path. The transfer movement 13 in FIG. 2 starts with the removal of the sheet metal part from the tool bottom part and ends far in front of the position (half the distance between or in the center with respect to the machining stages) represented by the centers of the tool bottom parts 1, 2.

FIG. 3 is based on a larger transfer movement 13, for example, for a larger sheet metal part. Therefore the tool bottom parts have a larger distance from one another than indicated in FIG. 1. In this case also, the depositing of the sheet metal part 6, which was taken out of the tool bottom part 1 and was transferred into the area of the intermediate depositing device 12, takes place as early as in front of half 25 the distance resulting from the centers of the tool bottom Darts. FIGS. 2 and 3 also show the removal of the sheet metal part $7^1$ far behind half the tool distance, viewed in the direction of the transfer movements.

For bridging the partial path 17 which is not travelled by the transfer device with the suction bars 9, 11, the intermediate depositing device 12 is used in the present invention. As a result, it is possible to cause during the return phase of the suction bars 9, 11 (the return movement 15, 16) a transfer movement (towards the right) of the sheet metal part $7^1$ resting on the intermediate depositing device 12. Likewise, the return travel of the intermediate depositing device 12 into the takeover position (left end area of the partial path 17) is still possible during the already starting transfer movement 13, 14 of the suction bars 9, 11.

Figure 4:
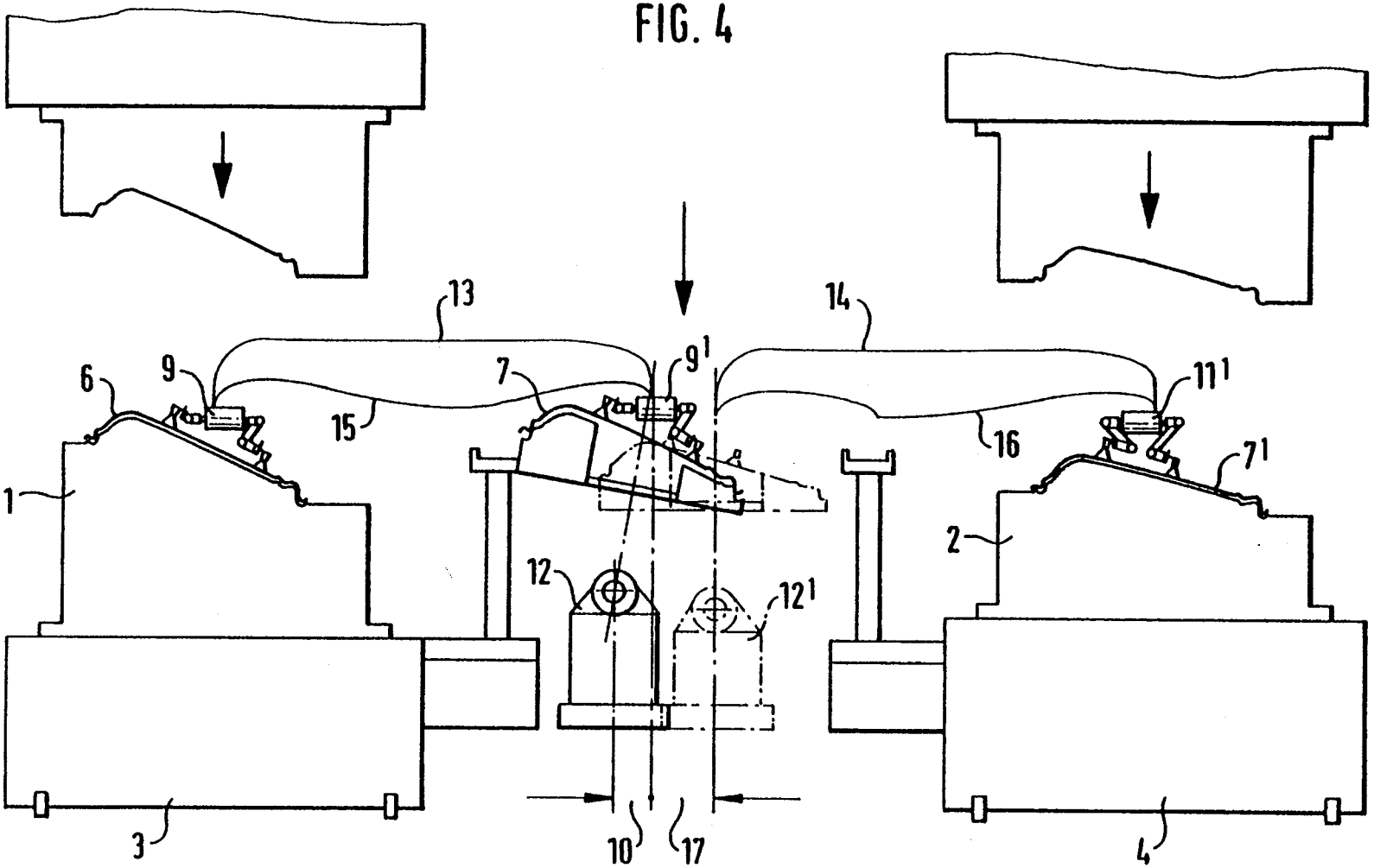
FIG. 4 is a representation of a diagram of the transfer movements generated by the drive of the forming machine of the present invention showing a partial movement to be carried out by the intermediate depositing device.

FIG. 4 illustrates an embodiment of the present invention which can perform the movements illustrated in FIGS. 2 and 3 with the partial path 17. Reference number 10 indicates the correcting path of the intermediate depositing device 12, as shown in the prior art device of FIG. 1, which is not a partial path according to the present invention. Because of the change of the oblique position of the sheet metal part 7 on the templates, the correcting path 10 is to be carried out in any event according to U.S. Pat. No. 5,048,318.

According to the embodiment of FIG. 4, the transfer movement of the sheet metal part 6 from the machining stage illustrated on the left with the tool bottom part 1 into the machining stage illustrated on the right with the tool bottom part 2 takes place as follows:

Corresponding to the course of the curve 13, the sheet metal part 6 taken from the tool bottom part 1 is brought into the position illustrated on the right by suction bars 9. A lowering movement for placing the sheet metal part 6 on the template 18 forms the end of this movement. At the same time as the removal movement from tool bottom part 1 and the transfer movement 13 for the sheet metal part 6, the sheet metal part 7 is taken from the template 18 of the intermediate depositing device 12 and deposited in the tool bottom part 2. The removal position for the sheet metal part 7 is offset in the transfer direction toward the right by the partial path 17 and the correcting path 10 with respect to the depositing position of the intermediate depositing device 12. As a result, the sheet metal part 6 deposited by the suction bars 9 on the template 18 of the intermediate depositing device 12 that had previously been moved to the left against the transfer movement is also rotated into a new oblique position to carry out the correcting movement, if this movement is required, and is moved along partial path 17. These movements may take place sequentially or in parallel. The suction bar $11^1$ must therefore be brought into the position for the removal of the sheet metal part 6, which is illustrated in phantom by position $12^1$ of the intermediate depositing device.

Figure 5:
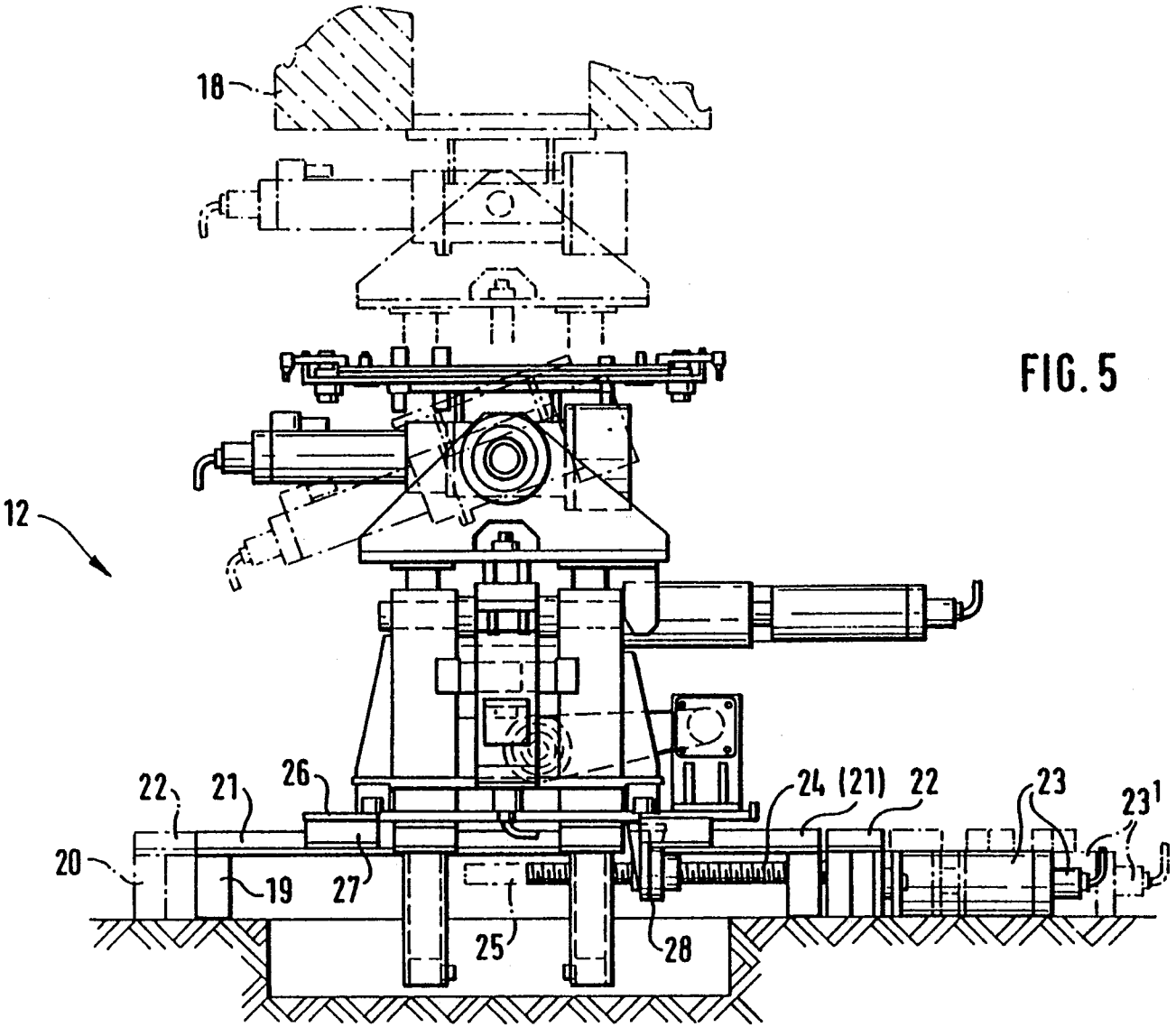
FIG. 5 is a face view of an intermediate depositing device.

FIG. 5 illustrates an intermediate depositing device 12 that is similar to that known from U.S. Pat. No. 5,048,318, but that is also movable to achieve the objects of the present invention. Intermediate depositing device of U.S. Pat. No. 5,048,318 was used as the starting point for the intermediate depositing device of the present invention. A mounting plate 26 can be displaced by means of guides 27 on rails 21 in the direction of the transfer movements 13, 14. On both sides, the rails 21 are lengthened by rail portions 22. In the same manner, the frame 19 is lengthened to the size which has the reference number 20. The motor 23 had to be displaced, and the spindle 24 had to be extended to the total length 25. These changes permit the intermediate depositing device to move over the partial path portion instead of the suction bars 9. The intermediate depositing device may be initially arranged in the center with respect to the tool bottom parts 1, 2. Because of its "moving path along partial path 17, the transfer movement 13, 14 of the suction bars 9 is less than half the distance from one machining stage to the next.

The adjusting device includes the motor 23 controlling the horizontal movement of the intermediate depositing device 12. The control of the movements of the intermediate depositing device 12 to coordinate with the movements of the transfer devices (suction bars 9) is easily accomplished by one of ordinary skill in the art. The motors of the adjusting device that control the oblique positioning and the height adjustment of the intermediate depositing device 12 are illustrated, but not referenced, as these are fully described in U.S. Pat. No. 5,048,318, and do not need to be described here for an understanding of the invention.

Although the invention has been described and illustrated in detail, it is to be clearly understood that the same is by way of illustration and example and is not to be taken by way of limitation. The spirit and scope of the present invention are to be limited only by the terms of the appended claims.

What is claimed:

1. A forming machine comprising;

at least two forming stations, the forming stations driven by a press drive and each forming station having means for shaping sheet metal parts;

a transfer device with holding devices movable by the press drive for gripping and transporting the sheet metal parts through the forming machine along a transfer direction between the forming stations;

at least one intermediate depositing device movably mounted along the transfer direction on horizontally extending rails between the two forming stations, the intermediate depositing device having at least one template for supporting the sheet metal parts;

an adjusting device coupled to the intermediate depositing device which adjusts the template on the intermediate depositing device in height, oblique position and horizontal orientation with respect to the sheet metal part to be deposited and gripped by the holding devices;

wherein the transfer movement of the holding devices is less than half the distance between two successive forming stations such that a partial path between the forming stations is not bridged by the transfer device, and the adjusting device has a range of action such that the intermediate depositing device is moved on the rails over the partial path to transfer the sheet metal parts between the holding devices within the partial path.

* * * * *